US007345262B2

(12) United States Patent
Keefe

(10) Patent No.: US 7,345,262 B2
(45) Date of Patent: Mar. 18, 2008

(54) MICROWAVE INTERACTIVE DISPLAY PACKAGE

(75) Inventor: Dan Keefe, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/268,017

(22) Filed: Nov. 7, 2005

(65) Prior Publication Data

US 2007/0102424 A1 May 10, 2007

(51) Int. Cl.
*H05B 6/80* (2006.01)

(52) U.S. Cl. ..... 219/725; 219/730

(58) Field of Classification Search ..... 219/725, 219/730, 726, 727, 728, 729, 731, 732, 733, 219/734, 735; *H05B 6/80*
See application file for complete search history.

(56) References Cited

U.S. PATENT DOCUMENTS

| | | | |
|---|---|---|---|
| 4,592,914 | A | 6/1986 | Kuchenbecker |
| 4,626,641 | A | 12/1986 | Brown |
| 4,775,771 | A | 10/1988 | Pawlowski |
| 4,785,160 | A | 11/1988 | Hart |
| 4,865,921 | A | 9/1989 | Hollenberg |
| 4,890,439 | A | 1/1990 | Smart |
| 4,891,482 | A | 1/1990 | Jaeger et al. |
| 4,936,935 | A | 6/1990 | Beckett |
| 4,963,424 | A | 10/1990 | Beckett |
| 5,071,062 | A | 12/1991 | Bradley et al. |
| 5,093,364 | A | 3/1992 | Richards |
| 5,117,078 | A | 5/1992 | Beckett |
| 5,213,902 | A | 5/1993 | Beckett |
| 5,221,419 | A | 6/1993 | Beckett |
| 5,260,537 | A | 11/1993 | Beckett |
| 5,266,386 | A | 11/1993 | Beckett |
| RE34,683 | E | 8/1994 | Maynard |
| 5,340,436 | A | 8/1994 | Beckett |
| 5,354,973 | A | 10/1994 | Beckett |
| 5,410,135 | A | 4/1995 | Pollart |
| 5,424,517 | A | 6/1995 | Habeger |
| 5,519,195 | A | 5/1996 | Keefer |
| 5,628,921 | A | 5/1997 | Beckett |
| 5,672,407 | A | 9/1997 | Beckett |
| 5,759,422 | A | 6/1998 | Schmelzer |
| 5,800,724 | A | 9/1998 | Habeger |
| 6,114,679 | A | 9/2000 | Lai |
| 6,150,646 | A | 11/2000 | Lai |
| 6,204,492 | B1 | 3/2001 | Zeng |
| 6,251,451 | B1 | 6/2001 | Zeng |
| 6,414,290 | B1 | 7/2002 | Cole |
| 6,433,322 | B2 | 8/2002 | Zeng |
| 6,455,827 | B2 | 9/2002 | Zeng |
| 6,552,315 | B2 | 4/2003 | Zeng |
| 6,677,563 | B2 | 1/2004 | Lai |
| 6,717,121 | B2 | 4/2004 | Zeng |

(Continued)

FOREIGN PATENT DOCUMENTS

| | | |
|---|---|---|
| EP | 1 452 458 | 1/2004 |

(Continued)

*Primary Examiner*—Daniel Robinson
(74) *Attorney, Agent, or Firm*—Womble Carlyle Sandridge & Rice, PLLC

(57) ABSTRACT

Various microwave energy interactive display packages, blanks for forming such packages, and methods of displaying and heating a food item are provided.

8 Claims, 6 Drawing Sheets

U.S. PATENT DOCUMENTS

| | | | | |
|---|---|---|---|---|
| 6,765,182 | B2 * | 7/2004 | Cole et al. | 219/730 |
| 7,019,271 | B2 * | 3/2006 | Wnek et al. | 219/730 |
| 2001/0001674 | A1 | 5/2001 | Simpson | |
| 2002/0100755 | A1 * | 8/2002 | Peterson | 219/727 |
| 2006/0049190 | A1 | 3/2006 | Middleton | |

FOREIGN PATENT DOCUMENTS

| | | |
|---|---|---|
| WO | WO 97/39949 | 10/1997 |
| WO | WO 01/92134 A1 | 12/2001 |

* cited by examiner

MICROWAVE INTERACTIVE DISPLAY PACKAGE

BACKGROUND

Microwave ovens have become a principle form of cooking food in a rapid and effective manner. As a result, the number of food items and packages available for use with a microwave oven is increasing. At the same time, there is also a need to minimize packaging both to conserve retail shelf space and to decrease raw materials costs. Thus, there is a need for improved materials, blanks, packages, and other constructs that enhance the microwave heating of foods while minimizing the materials used.

BRIEF DESCRIPTION OF THE DRAWINGS

The description refers to the accompanying drawings in which like reference characters refer to like parts throughout the several views, and in which.

DESCRIPTION

Figure 1:
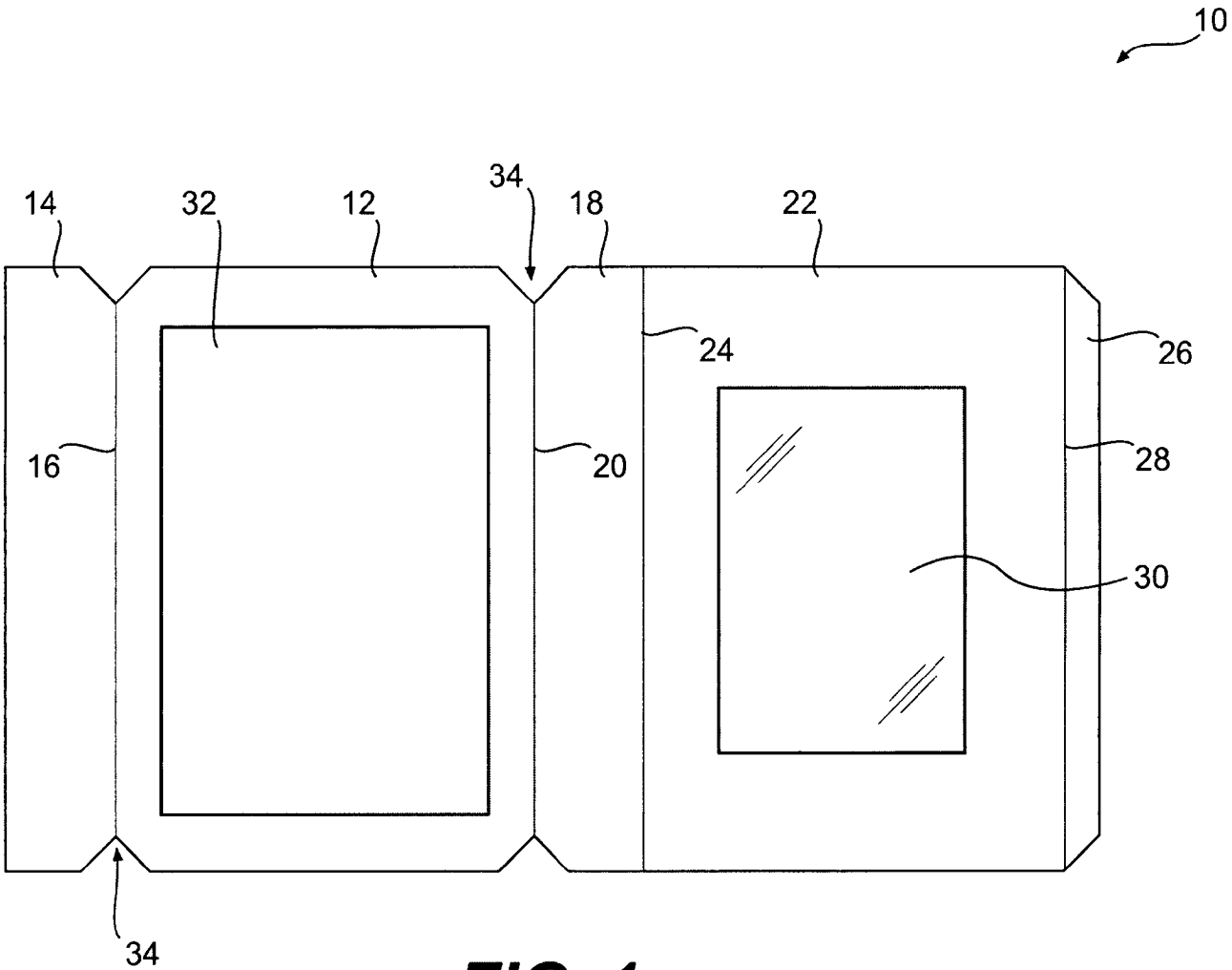
FIG. 1 depicts an exemplary blank that may be used according to various aspects of the present invention.

The present invention is directed generally to various blanks for forming a microwave energy interactive display package, various packages and packaging systems formed therefrom, various methods of making such packages and systems, and various methods of displaying and heating a food item. The packages may include one or more features that display a food item contained within the package. The packages also may include one or more features that enhance microwave heating of the food item.

According to some aspects of the present invention, a sleeve or package for heating a food item in a microwave oven is provided. According to various other aspects of the present invention, a sleeve, a tray or other food enclosing package (hereinafter "tray" except as indicated), and a microwave energy interactive heating package or packaging system are provided.

Any of the numerous sleeves, packages, or packaging systems described herein or contemplated hereby may include a display window or other feature that allows a food item wrapped in the tray to be visible without having to open the package. The sleeve also may include one or microwave energy interactive features. In one aspect, one or microwave energy interactive features are provided on a microwave energy interactive panel that may initially serve as a food-bearing surface.

Where the food item includes a bottom surface that ideally is browned, and a top surface that ideally is viewable by the purchaser, as with, for example, a pizza or open-faced sandwich, the food item may be positioned within the sleeve so that the surface to be browed is supported by or seated on the microwave energy interactive panel, and the top surface is visible through the display window or other viewing feature.

Where the food item includes a bottom surface that ideally is not browned, and a top surface that ideally is both browned and is visible, as with a cobbler or pot pie, the food item may be positioned within the sleeve so that the bottom surface is supported or seated on the microwave energy interactive panel, and the top surface is visible through the display window or other viewing feature. To heat the food item, the food item may be removed from the sleeve, the sleeve flipped over, and the food item inserted into the sleeve so the bottom surface of the food item is seated on or over the display window or other viewing feature and the top surface is in proximate or intimate contact with the microwave energy interactive panel. Similarly, where the food item is in a tray, the tray may be removed from the sleeve, the sleeve flipped over, and the tray inserted into the sleeve so the bottom of the tray is seated over the display window. In this manner, the microwave energy interactive feature is brought into proximate or intimate contact with the exposed food item contained in the tray to enhance the bulk or surface heating, browning, and/or crisping of the food item.

The present invention may be illustrated further by referring to the figures. For purposes of simplicity, like numerals may be used to describe like features. It will be understood that where a plurality of similar features are depicted, not all of such identical features may be labeled on the figures.

FIG. 1 depicts an exemplary blank 10 that may be used in accordance with various aspects of the present invention. The blank 10 includes a first, microwave energy interactive panel 12 joined to a first side panel 14 along a fold line 16, and a second side panel 18 joined to the microwave energy interactive panel 12 along a fold line 20. A display panel 22 is joined to the second side panel 18 along a fold line 24. A glue flap 26 is joined to the display panel 22 along a fold line 28.

In this and other aspects of the invention, the blank may be formed from any suitable material, for example, a paper, paperboard, or cardboard and may be flexible, semi-rigid, or substantially rigid. In one aspect, the blank is formed from paper generally having a basis weight of from about 15 to about 30 lbs/ream, for example, from about 20 to about 30 lbs/ream. In one particular example, the paper has a basis weight of about 25 lbs/ream. In another aspect, the blank is formed from paperboard having a basis weight of from about 30 to about 160 lbs/ream, for example, from about 80 to about 140 lbs/ream. The paperboard generally may have a thickness of from about 8 to about 30 mils, for example, from about 15 to about 28 mils. In one particular example, the paperboard has a thickness of about 26 mils. Any suitable paperboard may be used, for example, a solid unbleached sulfate board, such as SUS® board, commercially available from Graphic Packaging International. If needed or desired, one or more portions of the blank may be laminated to or coated with one or more different or similar sheet-like materials at selected panels or panel sections.

Still viewing FIG. 1, the display panel 22 includes a display window 30. In this example, the display window 30 is substantially rectangular in shape. However, it will be understood that the display window may have any dimensions and shape as needed or desired to display a particular food item in the package formed therefrom. Thus, for example, in this and other aspects, the display window may be positioned to show only a portion of the food contained in the package. In some examples, the display window may be covered with a translucent or transparent, colored or colorless polymeric film. In other examples, the display window may be left as an uncovered opening through which the food item can be viewed.

In this and other aspects of the present invention, the microwave energy interactive panel 12 may include one or more features that render the package microwave energy interactive. Such features may include one or more microwave energy interactive materials that promote browning and/or crisping of the food item during microwave heating. In the example shown in FIG. 1, a susceptor material 32 overlies a portion of the microwave energy interactive panel 12. Depending on the microwave energy interactive material selected and its positioning in the packaging, the microwave energy interactive material may absorb microwave energy, transmit microwave energy, or reflect microwave energy as desired for a particular food item.

A susceptor used in accordance with the present invention may comprise a microwave energy interactive material deposited on or supported by a substrate. The microwave energy interactive material may comprise an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination thereof.

While metals are inexpensive and easy to obtain in both vacuum deposited or foil forms, metals may not be suitable for every application. For example, in high vacuum deposited thickness and in foil form, metals are opaque to visible light and may not be suitable for forming a clear microwave package or component. Further, the interactive properties of such vacuum deposited metals for heating often are limited to heating for narrow ranges of heat flux and temperature. Such materials therefore may not be optimal for heating, browning, and crisping all food items. Additionally, for field management uses, metal foils and vacuum deposited coatings can be difficult to handle and design into packages, and can lead to arcing at small defects in the structure.

If desired, the microwave interactive energy material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, or a combination thereof. To form the susceptor, ITO typically is sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

The substrate used in accordance with the present invention typically comprises an electrical insulator, for example, a polymeric film. The thickness of the film may typically be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

According to one aspect of the present invention, the polymeric film may comprise polyethylene terephthalate. Examples of polyethylene terephthalate film that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIK WAVE® Focus susceptor and the MICRO-RITE® susceptor, both available from Graphic Packaging International (Marietta, Ga.).

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating, circles, loops, hexagons, islands, squares, rectangles, octagons, and so forth. Examples of alternative patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of the microwave energy interactive material are shown and described herein, it should be understood that other patterns of microwave energy interactive material are contemplated by the present invention.

Still viewing FIG. 1, one or more cutouts 34 may be provided in the various panels if desired. In some instances, such cutouts may provide an aesthetic or functional benefit, for example, to ensure that the packages stack more neatly.

In still other instances, such cutouts may be used to provide strength or stability to the corners that might otherwise be crushed during shipping and handling. Nonetheless, it will be understood that the present invention contemplates numerous variations of the blanks, trays, packages, and packaging systems shown herein.

Figure 2:
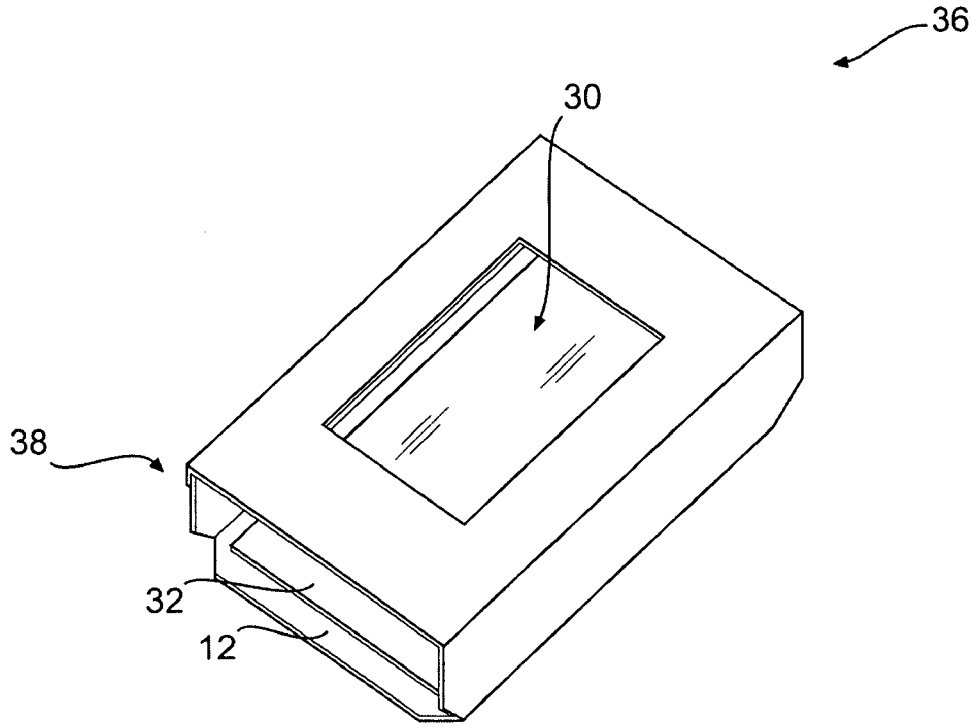
FIG. 2 depicts the exemplary blank of FIG. 1 folded into a sleeve, in accordance with various aspects of the present invention.

To form the blank 10 into a sleeve, the glue flap 26 is brought towards the first side panel 14. In doing so, the blank 10 is folded along fold lines 16, 20, 24, and 28. The glue flap 26 is adhesively joined to the first side panel 14 to form a sleeve 36, as shown in FIG. 2. In this configuration, the microwave energy interactive panel and the display panel are positioned to be in an opposed, facing relation with respect to one another. It will be understood that while the sleeve of this example and others herein are assembled using an adhesive, other thermal, chemical, or mechanical methods or techniques may be used to secure the panels. Additionally, it will be understood that other methods, steps, and sequences may be used to manipulate the various panels to form the sleeve. The sleeve 36 includes at least one open end 38 through which a food item or tray can be inserted.

Figure 3:
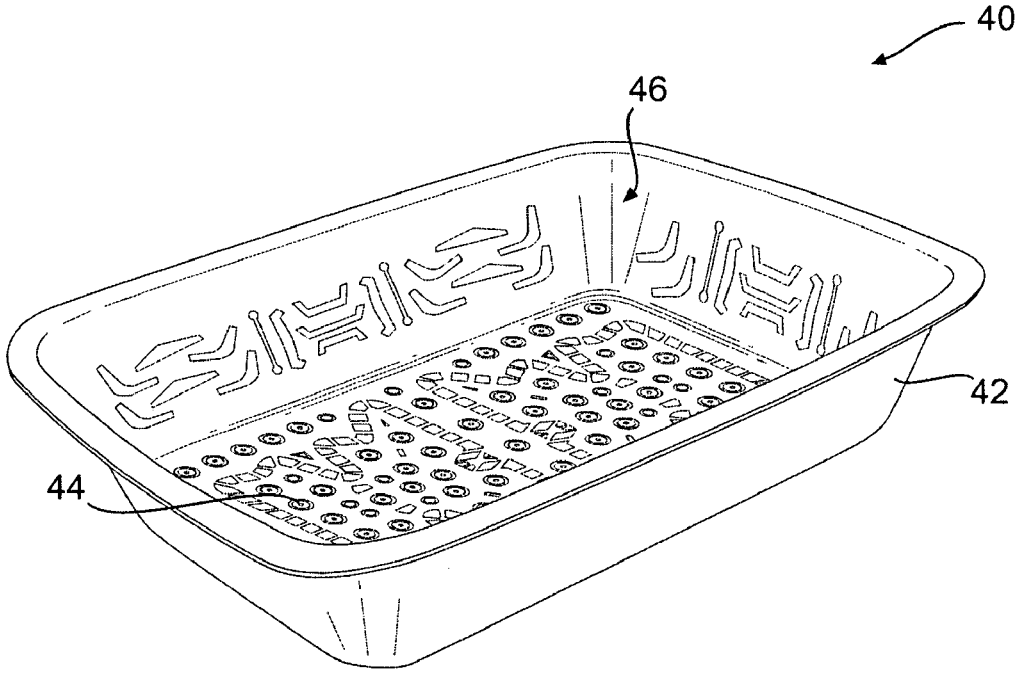
FIG. 3 depicts an exemplary tray that may be used according to various aspects of the present invention.

FIG. 3 depicts an exemplary tray 40 that may be used in accordance with various aspects of the present invention, for example, with the sleeve 36 of FIG. 2. The tray 40 includes a plurality of walls 42, a bottom panel 44, and an interior space 46. A food item suitable for heating in a microwave oven may be placed within the tray. In this example, the tray might be suitable for a single or multi-serving entrée, such as lasagna, a casserole, a vegetable dish, or any other food item. In this and other aspects of the invention, the tray may be formed from the same or a different material as the sleeve, for example, a coated or uncoated paper, paperboard, or cardboard, or a molded polymer, or any combination thereof. Examples of some of such materials include, but are not limited to, those described above with reference to FIG. 1. Examples of additional materials that may be used to form a molded tray include, but are not limited to, polypropylene, polyethylene, or any combination thereof.

If desired, one or more of the walls and/or the bottom panel of the tray may be provided with features that enhance the microwave heating of a food item therein. Such materials may absorb, reflect, or transmit microwave energy as needed or desired to attain the desired heating, browning, and crisping of the food item. For example, a susceptor material, such as those described herein, may be used on the interior surface of one or more walls and/or the bottom panel of the tray.

In this and other aspects of the present invention, a polymer film or other overwrap material (not shown) may at least partially overlie the tray to seal the food item therein. The film may be used to create a pouch or bag to enclose the entire tray, or may be used as a sheet simply to enclose the interior space of the tray. Further, the film may be used to enclose a tray within a sleeve.

In one example, a polymeric film is used to create or provide a water barrier, oxygen barrier, or a combination thereof. Suitable polymer films may include, but are not limited to, ethylene vinyl alcohol, barrier nylon, polyvinylidene chloride, barrier fluoropolymer, nylon 6, nylon 66, coextruded nylon 6/EVOH/nylon 6, silicon oxide coated film, or any combination thereof.

One example of a barrier film that may be suitable for use as an overwrap with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.).

The barrier film may have an oxygen transmission rate (OTR) as measured using ASTM D3985 of less than about 20 cc/m$^2$/day. In one aspect, the barrier film has an OTR of less than about 10 cc/m$^2$/day. In another aspect, the barrier film has an OTR of less than about 1 cc/m$^2$/day. In still another aspect, the barrier film has an OTR of less than about 0.5 cc/m$^2$/day. In yet another aspect, the barrier film has an OTR of less than about 0.1 cc/m$^2$/day.

The barrier film may have a water vapor transmission rate (WVTR) as measuring using ASTM F1249 of less than about 100 g/m$^2$/day. In one aspect, the barrier film has a water vapor transmission rate (WVTR) as measuring using ASTM F1249 of less than about 50 g/m$^2$/day. In another aspect, the barrier film has a WVTR of less than about 15 g/m$^2$/day. In yet another aspect, the barrier film has a WVTR of less than about 1 g/m$^2$/day. In still another aspect, the barrier film has a WVTR of less than about 0.1 g/m$^2$/day. In a still further aspect, the barrier film has a WVTR of less than about 0.05 g/m$^2$/day.

To use the exemplary microwave package or heating system depicted in FIGS. 2 and 3, a tray 40 with a food item (not shown) therein is placed into a sleeve 36 such that the food item is visible though the display window 30. In this configuration, the bottom panel 44 of the tray 40 is superposed with the microwave energy interactive panel 12 of the sleeve 36.

Prior to microwave heating, the tray 40 may be removed from the sleeve 36 and any overwrap (not shown) removed, for example, according to instructions (not shown) provided on the package. The sleeve 38 then is flipped over so that the display window 30 is aligned with the bottom 44 of the tray 40. The tray 40 then is inserted into the sleeve 36 such that the bottom panel 44 of the tray 40 is superposed with the display window 30, and the microwave energy interactive panel 12 is in proximate or intimate contact with the surface of the now exposed food item in the unwrapped tray 40.

When the microwave interactive display package is placed in a microwave oven and exposed to microwave energy, the microwave energy interactive material on the sleeve 36 enhances the browning and crisping of the surface of the food item. Additionally, where the tray 40 includes a microwave energy interactive material on one or more interior surfaces proximate the food item, the microwave energy is reflected, transmitted, or absorbed, depending on the material selected, and the heating of the food item is enhanced. Thus, the package of the present invention serves as a display for the food item, and also a heating system for heating in a microwave oven.

Figure 4:
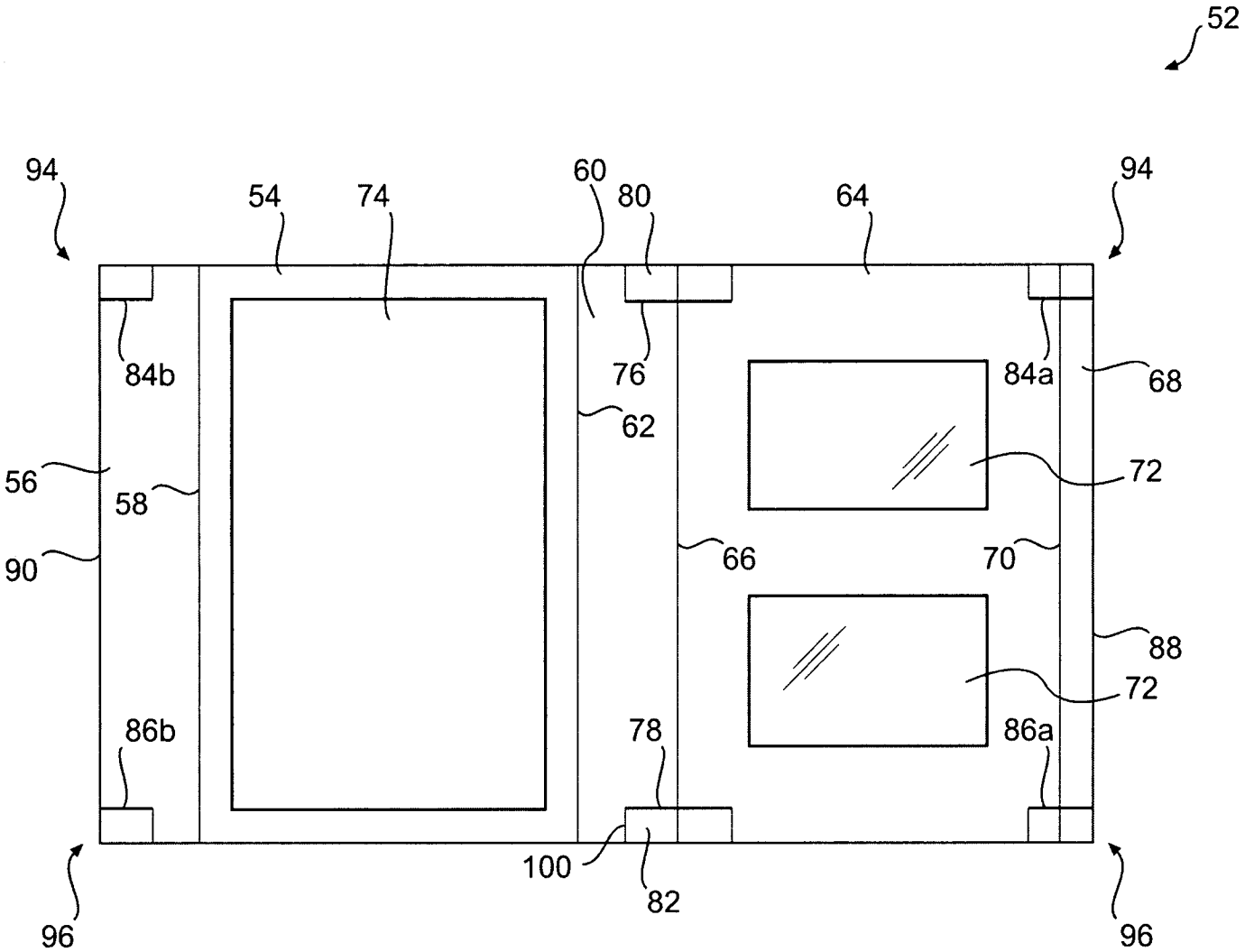
FIG. 4 depicts another exemplary blank that may be used according to various aspects of the present invention.

FIG. 4 depicts another exemplary blank 52 that may be used to form a sleeve in accordance with various aspects of the present invention. The blank 52 includes a first, microwave energy interactive panel 54 joined to a first side panel 56 along a fold line 58 and a second side panel 60 joined to the microwave energy interactive panel 54 along a fold line 62. A display panel 64 is joined to the second side panel 60 along a fold line 66. A glue flap 68 is joined to the display panel 64 along a fold line 70.

Still viewing FIG. 4, the display panel 64 includes two display windows 72. In this example, the display windows 72 are substantially rectangular in shape. However, it will be understood that the display windows may have any dimensions and shape as needed or desired to display a particular food item in the package formed therefrom. Thus, where more than one display window is used, each display window may have the same size and/or shape, or may have a different size and/or shape.

The microwave energy interactive panel 54 may include one or more features that render the package microwave energy interactive. Such features may include one or more microwave energy interactive materials that promote browning and/or crisping of the food item during microwave heating. In this example, a susceptor material 74 overlies a portion of the microwave energy interactive panel 54.

In the exemplary blank 52 shown in FIG. 4, slits 76, 78 extend between the display panel 54 and the second side panel 60 to form locking features 80, 82, respectively. Slits 84*a*, 86*a* extend from the edge 88 of the glue flap 68 into the display panel 64, and slits 84*b*, 86*b* extend from the edge 90 of the first side panel 56 into the first side panel 56.

Figure 5A:
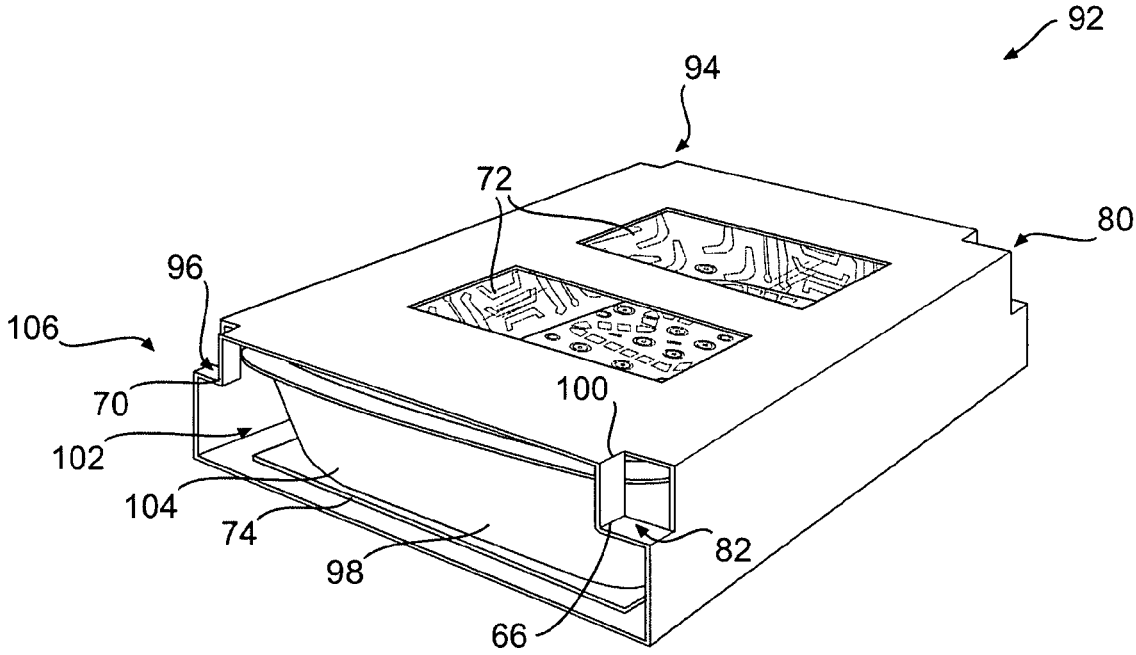
FIG. 5A depicts the exemplary blank of FIG. 4 folded into a sleeve, and configured to display a food item, in accordance with various aspects of the present invention.

FIG. 5A depicts a sleeve 92 formed from the exemplary blank 52 of FIG. 4 with a tray 98 housed inside the sleeve 92. The sleeve 92 may be formed from the blank 52 in a similar manner as described in connection with the blank 10 of FIG. 1. In this configuration, the microwave energy interactive panel and the display panel are positioned to be in an opposed, facing relation with respect to one another. When aligned and assembled into the sleeve, slits 84*a* and 84*b* overlap to form locking feature 94, and slits 86*a* and 86*b* overlap to form locking feature 96. After the tray 98 is inserted into the sleeve 92, and each locking feature 80, 82, 94, and 96 is folded along fold lines 66 and 70 and along any additional minor fold lines provided to assist with engaging and disengaging the locking features, such as fold line 100 (FIG. 4), toward the cavity or interior 102 of the sleeve 92. In doing so, each locking feature 80, 82, 94, and 96 engages the exterior 104 of the tray 98, thereby preventing it from being removed without physically damaging the sleeve 92. Alternatively or in addition, one or more locking features in the form of flaps (not shown) can be attached to the ends of the sleeve for closing, or at least partially closing, at least one end of the sleeve, or for securing the tray within the sleeve.

Still viewing FIG. 5A, the tray 98 is housed within the sleeve 92 such that a food item (not shown) contained therein is visible though the display windows 72. In this configuration, the bottom panel 107 of the tray 98 is superposed with the microwave energy interactive panel 54 of the sleeve 92.

Prior to microwave heating, the tray 98 may be removed from the sleeve 92 and any overwrap (not shown) removed, for example, according to instructions (not shown) provided on the package. To remove the tray 98, one or more of the locking features 80, 82, 94, and 96, as needed, are folded along its respective fold line 66 or 70 away from the tray 98. In doing so, removal of the tray 98 through the at least one open end 106 of the sleeve 92 is substantially unimpeded.

Figure 5B:
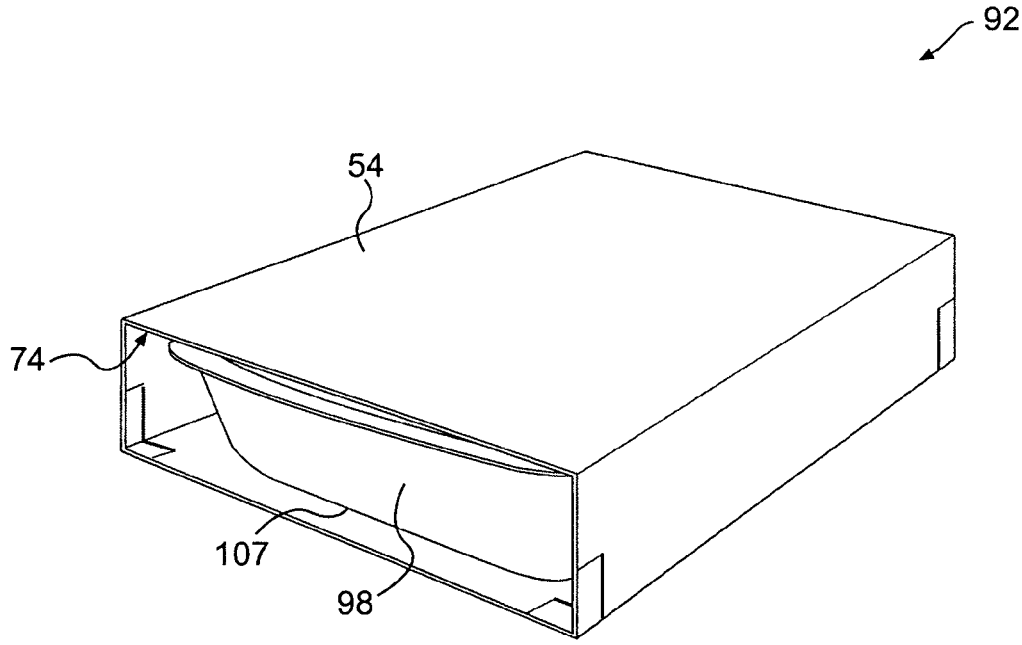
FIG. 5B depicts the exemplary blank of FIG. 4 folded into a sleeve and configured to brown and crisp a food item, in accordance with various aspects of the present invention.

The sleeve 92 is then flipped over so that the display windows 72 are aligned with the bottom panel 107 of the tray 98. As shown in FIG. 5B, the tray 98 is inserted into the sleeve 92 such that the bottom panel 107 of the tray 98 is superposed with the display windows 72, and the susceptor material 74 overlying at least a portion of the microwave energy interactive panel 54 is in proximate or intimate contact with the surface of the now exposed food item (not shown) in the unwrapped tray 98.

As with the other examples described herein and contemplated hereby, when the microwave interactive display package is placed in a microwave oven and exposed to microwave energy, the microwave energy interactive material on the sleeve and/or tray enhances the browning, crisping, and heating of the food item.

Figure 6:
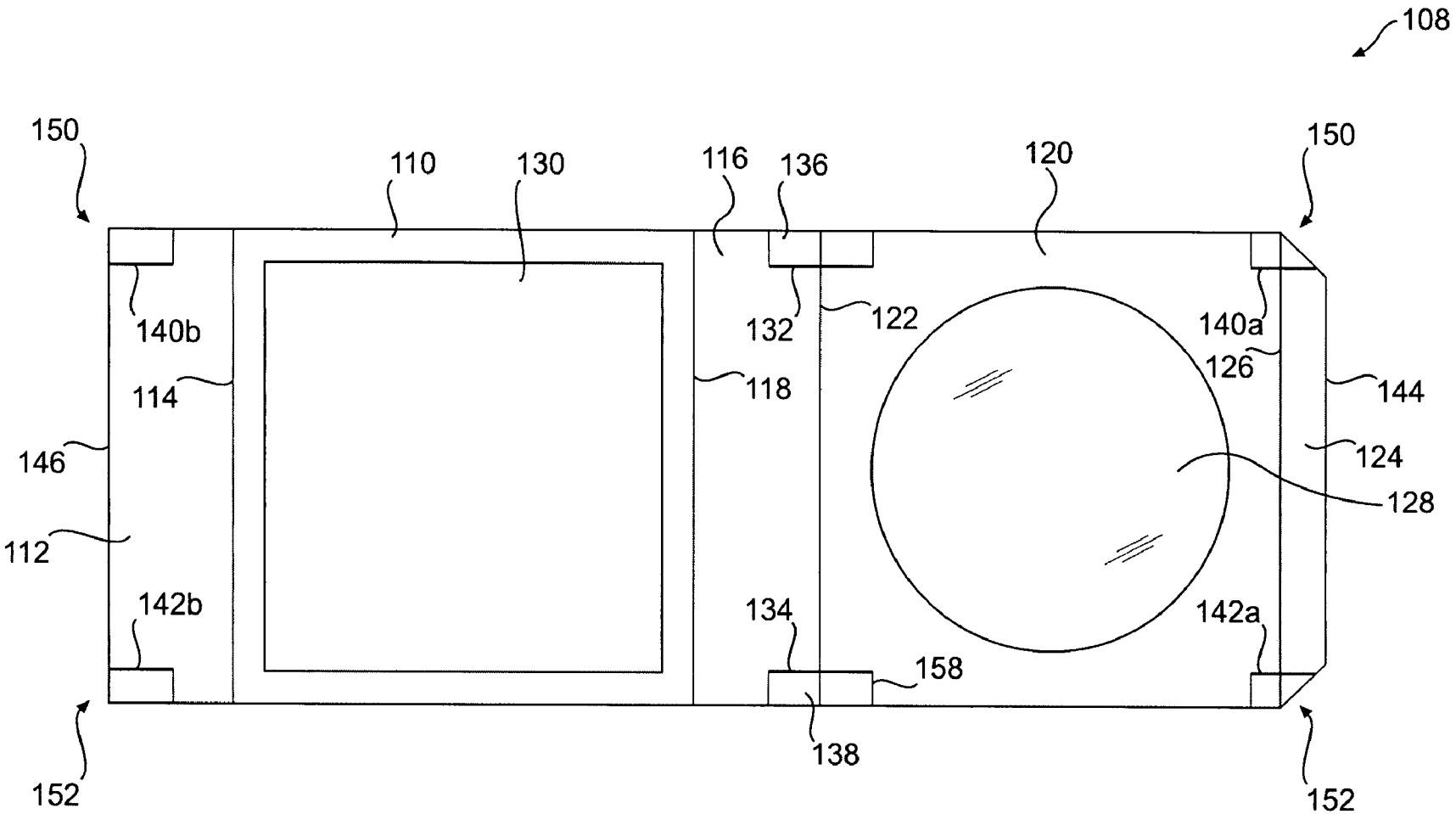
FIG. 6 depicts yet another exemplary blank that may be used according to various aspects of the present invention.

FIG. 6 depicts another exemplary blank 108 that may be used in accordance with various aspects of the present invention. The blank 108 includes a first, microwave energy interactive panel 110 joined to a first side panel 112 along a fold line 114 and a second side panel 116 joined to the microwave energy interactive panel 110 along a fold line 118. A display panel 120 is joined to the second side panel 116 along a fold line 122. A glue flap 124 is joined to the display panel 120 along a fold line 126.

The display panel 120 includes a display window 128. In the example shown in FIG. 6, the display window 128 is substantially circular in shape. However, it will be understood that the display window may have any dimensions and shape as needed or desired to display a particular food item in the package formed therefrom.

As with the other exemplary sleeves described herein and compassed hereby, the microwave energy interactive panel 110 may include one or more features that render the package microwave energy interactive, for example, a susceptor material 130 overlies a portion of the microwave energy interactive panel 110.

In the example blank 108 shown in FIG. 6, slits 132, 134 extend between the display panel 120 and the second side panel 116 to form locking features 136, 138, respectively. Slits 140*a*, 142*a* extend from the edge 144 of the glue flap 124 into the display panel 120, and slits 140*b*, 142*b* extend from the edge 146 of the first side panel 112 into the first side panel 112. A sleeve 148 (FIGS. 7A and 7B) may be formed from the blank 108 in a similar manner as described in connection with blank 10 of FIG. 1 and blank 52 of FIG. 5. When aligned and assembled into the sleeve (FIG. 7A), slits 140*a* and 140*b* overlap to form locking feature 150, and slits 142*a* and 142*b* overlap to form locking feature 152.

Figure 7A:
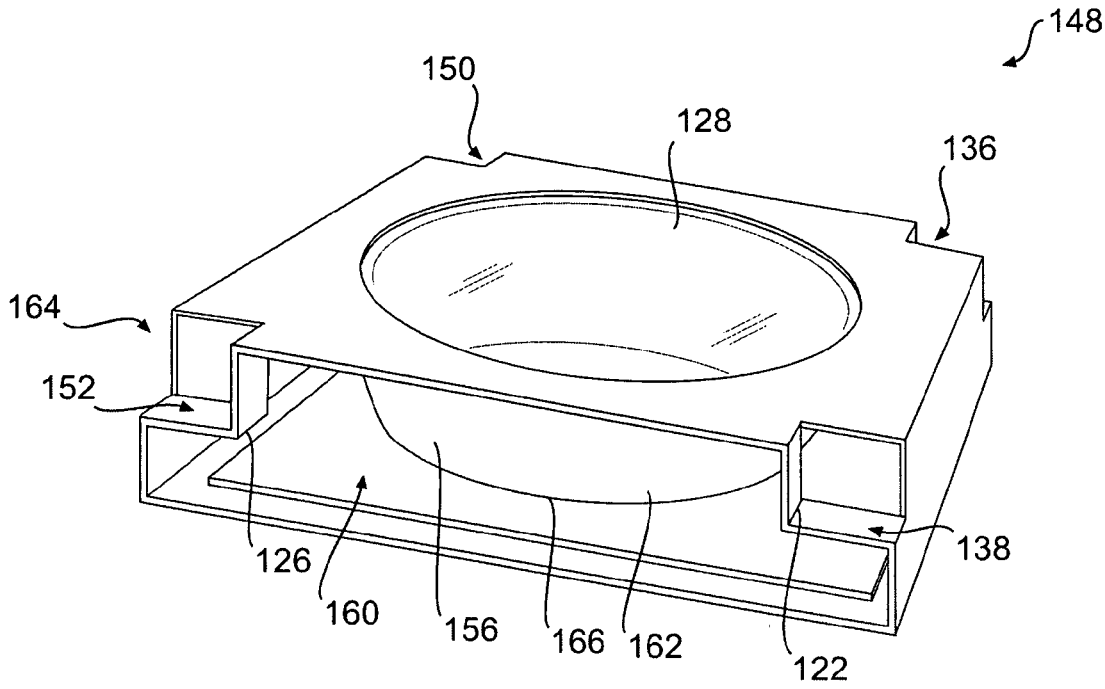
FIG. 7A depicts the exemplary blank of FIG. 6 folded into a sleeve and configured to display a food item, in accordance with various aspects of the present invention.
Figure 7B:
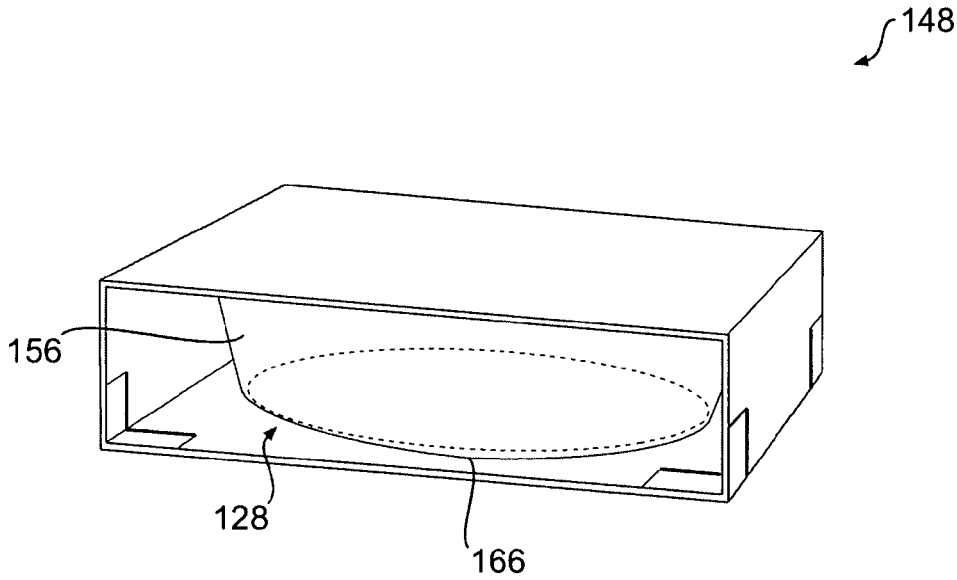
FIG. 7B depicts the exemplary blank of FIG. 6 folded into a sleeve and configured to brown and crisp a food item, in accordance with various aspects of the present invention.

FIG. 7A depicts the sleeve 148 formed from the exemplary blank 108 of FIG. 6 with a tray 156 housed inside the sleeve 148. After the tray 156 is inserted into the sleeve 148, and each locking feature 136, 138, 150, and 152 is folded along fold lines 122 and 126 and along any associated minor fold lines 158 (FIG. 6), toward the interior 160 of the sleeve 148. In doing so, each locking feature 136, 138, 150, and 152 engages the exterior 162 of the tray 156, thereby preventing it from being removed without physically damaging the sleeve 148. To remove the tray 156, one or more of the locking features 136, 138, 150, and 152, as needed, are folded along its respective fold line 122 or 126 away from the tray 156. In doing so, removal of the tray 156 through the at least one open end 164 of the sleeve 148 is substantially unimpeded.

To use the tray 156 and sleeve 148 system to heat a food item, for example, a pot pie, the user removes the tray 156 from the sleeve 148, removes any overwrap, turns the sleeve 148 upside down, and inserts the tray 156 into the sleeve 148 so that the bottom 166 of the tray 156 overlies the display window 128, as shown in FIG. 8B. When the food item is heated in the microwave oven, the microwave interactive material or materials on the sleeve and/or tray enhance the heating, browning, and/or crisping of all or a portion of the food item, as desired.

It will be understood that while numerous blanks, sleeves, trays, packages, other constructs, and various combinations thereof are described herein, numerous other blanks, sleeves, trays, packages, and other constructs are contemplated hereby. It also will be understood that various materials or combinations of materials may be used to form a blank, sleeve, tray, package, or other construct according to the present invention.

Thus, for example, while the exemplary sleeves described herein generally are formed from a paper, paperboard, cardboard, or other materials, or combinations thereof that are sufficiently rigid to be folded, numerous other materials and configurations are contemplated hereby. Thus, for example, a sleeve used in accordance with the present invention may be formed partially or entirely from one or more flexible polymeric packaging materials with the microwave energy interactive material overlying a portion thereof. Thus, for example, the sleeve could be formed from one or more translucent, opaque, and/or printed polymeric films and have a transparent colored or colorless display window for viewing the food item therein. Alternatively, the display panel or portion may be formed substantially or entirely from one or more transparent materials, with the remaining panels being formed from one or more translucent, opaque, and/or printed polymeric films. Numerous configurations are contemplated by this invention.

Likewise, it will be understood that although use of a rigid or semi-rigid tray is described herein, the food item may be partially or completely enclosed within any suitable package type or configuration. Thus, for example, the food item may be enclosed with a package that is formed partially or entirely from one or more flexible materials, for example, a paper, polymeric film, or other suitable material. The sleeve may be formed from a rigid, semi-rigid, or flexible material, or any combination thereof. In any of such exemplary constructions, the package enclosing the food item may be formed from one or more barrier films, such as those described herein.

Any of the blanks, sleeves, trays, packages, or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. patent application Ser. No. 11/211,858, to Middleton, et al., titled "Absorbent Microwave Interactive Packaging", filed Aug. 25, 2005, both of which are incorporated herein by reference in their entirety. Additionally, the package may include graphics or indicia printed thereon.

Optionally, one or more panels of the blanks, sleeves, trays, packages, or other constructs described herein or contemplated hereby may be coated with varnish, clay, or other materials, either alone or in combination. The coating may then be printed over with product, advertising, and other information or images. The blanks, trays, packages, and systems also may be coated to protect any information printed thereon. The blanks, trays, packages, and systems may be coated with, for example, a moisture barrier layer, on either or both sides.

It will be understood that in each of the various blanks and trays described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; and various combinations of these features. Where cutting is used to create a fold line, the cutting typically will not be overly extensive in a manner that might cause a reasonable user to consider incorrectly the fold line to be a tear line.

The terms "adhesive" and "glue" and "glued" are intended to encompass any adhesive or manner or technique for adhering materials as are known to those of skill in the art. While use of the terms "adhesive" and "glue" and "glued" are used herein, it will be understood that other methods of securing the various flaps are contemplated hereby.

Although numerous embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A package comprising a plurality of adjoined panels defining a cavity for receiving a food item, the food item including at least one surface intended to be browned and/or crisped in a microwave oven, wherein the plurality of adjoined panels includes a first panel including a transparent viewing window, and a second panel opposed to the first panel, the package includes a microwave energy interactive material overlying at least a portion of the second panel, the microwave energy interactive material being capable of converting microwave energy to thermal energy, in a first configuration, the transparent viewing window displays at least a portion of the surface of the food item intended to be browned and/or crisped, and in a second configuration inverted from the first configuration, the microwave energy interactive material is adjacent to at least a portion of the surface of the food item intended to be browned and/or crisped.

2. The package of claim 1, wherein the transparent viewing window comprises an aperture circumscribed by the first panel.

3. The package of claim 1, wherein a substantially transparent polymer film overlies the transparent viewing window.

4. The package of claim 1, wherein the transparent viewing window is a first transparent viewing window, and the first panel includes a second transparent viewing window.

5. The package of claim 1, wherein the plurality of panels further includes a first side panel and a second side panel in an opposed relation, at least a first slit extends continuously through the first panel and the first side panel, and at least a second slit extends continuously though the first panel and the second side panel.

6. The package of claim 5, wherein the first slit and the second slit each define a locking feature for securing a tray within the cavity.

7. The package of claim 1, in combination with a tray dimensioned to be received within the cavity.

8. A method of using the package of claim 1, comprising:

inserting the food item into the package such that the surface to be browned and/or crisped can be seen through the transparent viewing window;

removing the food item from the package prior to heating the food item in a microwave oven;

inverting the package;

inserting the food item into the package such that the surface to be browned and/or crisped is positioned adjacent to the microwave energy interactive material; and exposing the food item to microwave energy m a microwave oven.

* * * * *